US005241920A

United States Patent [19]

Richardson

[11] Patent Number: 5,241,920

[45] Date of Patent: Sep. 7, 1993

[54] HOOK ASSEMBLY FOR BROKEN TOW LINE RETRIEVAL AND EMERGENCY MARINE TOWING

[76] Inventor: Lee E. Richardson, 9122 S. Federal Hwy., Port St. Lucie, Fla. 34952

[21] Appl. No.: 881,464

[22] Filed: May 11, 1992

[51] Int. Cl.[5] ..... B63B 21/66

[52] U.S. Cl. ..... 114/246; 114/253; 114/221 R

[58] Field of Search ..... 114/221 R, 219, 297, 114/253, 246, 210, 254

[56] References Cited

U.S. PATENT DOCUMENTS

| | | | |
|---|---|---|---|
| 3,094,095 | 6/1963 | Litchfield et al. | 114/297 |
| 3,929,087 | 12/1975 | Montgomery | 114/297 |
| 4,098,216 | 7/1978 | Bruce | 114/221 R |
| 4,724,789 | 2/1988 | Van Den Haak | 114/221 R |
| 5,042,413 | 8/1991 | Benoit | 114/221 R |

*Primary Examiner*—Joseph F. Peters, Jr.
*Assistant Examiner*—Stephen P. Avila

[57] ABSTRACT

A controllable hook assembly and method for retrieving a barge's towing bridle or broken tow cable while maintaining a safe standoff distance between the drifting vessel and the recovery vessel. It may also be used for emergency towing of a vessel adrift or otherwise in distress. The disclosed assembly consists of a bidirectional side-planing otterboard integrated with a retrieval/towing hook which is shackled to a recovery towline. The depth and lateral position of the towed assembly are controlled by the length of recovery towline and the speed of the recovery towing vessel, respectively.

6 Claims, 2 Drawing Sheets

HOOK ASSEMBLY FOR BROKEN TOW LINE RETRIEVAL AND EMERGENCY MARINE TOWING

BACKGROUND OF THE INVENTION

This invention relates to a simpler and safer means of retrieving a broken marine tow cable or, in an emergency, taking a drifting barge or other vessel temporarily in tow by hooking the chain bridle or anchor chain of said vessel from a safe distance.

A problem exists when, at sea, a vessel tries to take another in tow. The case arises with a tug and tow when the barge breaks loose, usually in heavy weather, but also occurs when a vessel's powerplant fails and an assisting vessel tries to take it in tow. The need for such a device gave rise to the hook assembly described in U.S. Pat. No. 4,242,978 which can be used to retrieve the towing bridle portion of a broken tow. A hook is towed around a barge using a float to keep the hook at the proper depth until the chain bridle is snared. Said device avoids the use of an auxiliary tow line mounted on the barge or the method of putting personnel on the barge to reconnect the tow; methods which are unwieldy, unsafe, or both. U.S. Pat. No. 4,037,555 is a similar method for retrieving a buoy. The hook and float method is, however, time-consuming and not very effective in rough seas. It does not achieve or fulfill the purpose of the present invention.

My device can be used to retrieve either the towing bridle or the towing cable still attached to the drifting barge. By laterally positioning the hook assembly to either port or starboard of the towing vessel, the towing vessel can pass at a safe distance and still hook the towing bridle or cable, which is hanging down generally vertically below the drifting barge or other vessel to be towed.

There are several methods of subsurface lateral displacement, the most common being otterboards or trawl doors used for opening the mouth of a trawl net as in U.S. Pat. No. 4,879,830. Other examples are U.S. Pat. No. 4,756,268 which laterally displaces towed seismic cables, and U.S. Pat. No. 3,507,068 and other, small devices used to control fishing lines or trolling lines. However, the method of using lateral displacement to retrieve a hanging cable is new.

The preferred method of restoring a broken tow is to retrieve the tow cable and "strip" the cable, bringing it aboard the towing vessel a section at a time until the broken end is reached, then coupling it to the residual tow cable still on the towing winch. However, if the cable broke at the connection to the chain bridle, if the weather is severe, or if the drifting barge is in danger of going aground, my device can be used to hook the chain bridle, get the barge under control, and tow until such time as the weather abates or to a more sheltered or otherwise suitable location where a more permanent coupling can be made.

In the event of a vessel in distress, the normal procedure is to send over a small "shot line" or "heaving line" which is connected to larger and larger lines until a tow line of suitable diameter is reached and made fast to the distressed vessel. This method can involve a great deal of effort and in severe weather is highly dangerous. Using my system, the distressed vessel need only let out a suitable length (e.g. two "shots", or 180 feet) of anchor chain and an emergency tow can be easily and safely established.

The subjected device can be easily carried aboard the towing or rescue vessel and can be shackled to a tow line in time of need. The depth and lateral position of the hooking assembly is controllable by the length of the recovery tow line deployed and the speed of the vessel (general guidelines for tow cable lengths and towing speeds may be engraved on the device).

The speed and simplicity of my device combined with its optional bidirectional capability makes it advantageous even in relatively shallow water. By preventing a barge or vessel from going aground lives and property can be saved and, in the event of a petroleum or bulk chemical barge, massive ecological damage can be averted.

DESCRIPTION OF THE PREFERRED EMBODIMENT

Figure 1:
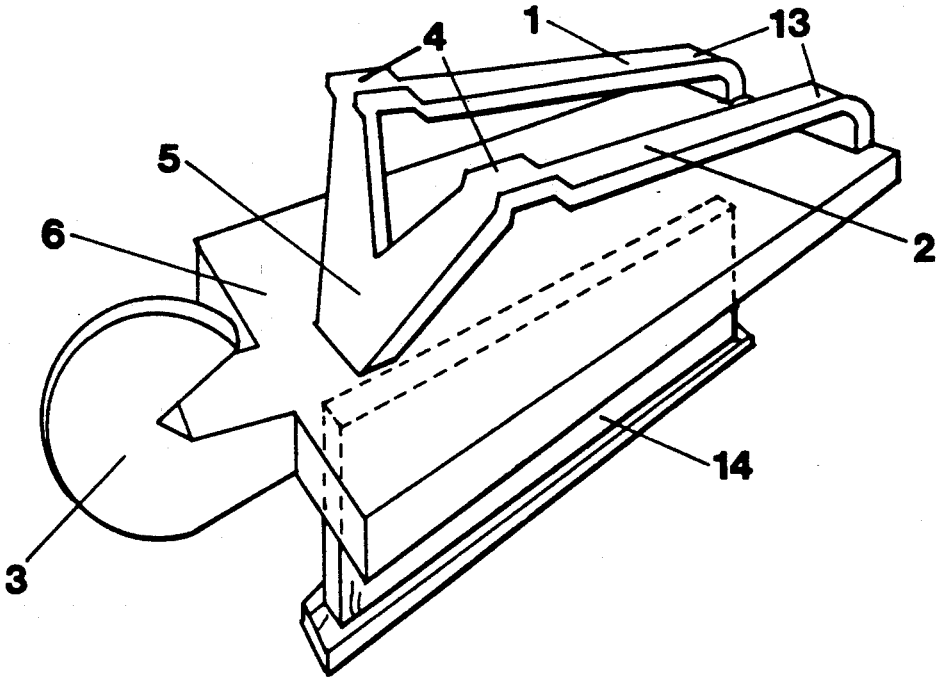
FIG. 1 is a perspective view showing one example of the integral retrieval hook assembly in accordance with my invention.

Referring now to the drawings, FIG. 1 shows a perspective view of a preferred embodiment of the hook assembly. The device is shackled to a recovery towing cable at towing struts 1 or 2, each strut determining the direction of lateral movement in the towed condition. For lateral planning, the shackle will rest in the notched section 4 of the strut. The device will hang and plane naturally from this position with the hook 3 foremost. As it is lowered over the stern of the towing vessel into the water and towed the side-planing component 6 will cause the device to move laterally with respect to the towing vessel. This side-planing plate 6 is somewhat like a trawl net otterboard. The weighted keel 14 (also shown in FIG. 3) provides directional stability and keeps the device in a generally vertical position by offsetting the asymmetrical component of the towing force about the longitudinal axis (i.e. the distance between notch 4 and the centerline). Using the guidelines engraved on the underside of the plate 6, an amount of cable will be let out to achieve the desired depth and the towing vessel brought to a speed which will give the desired lateral displacement.

Figure 2:
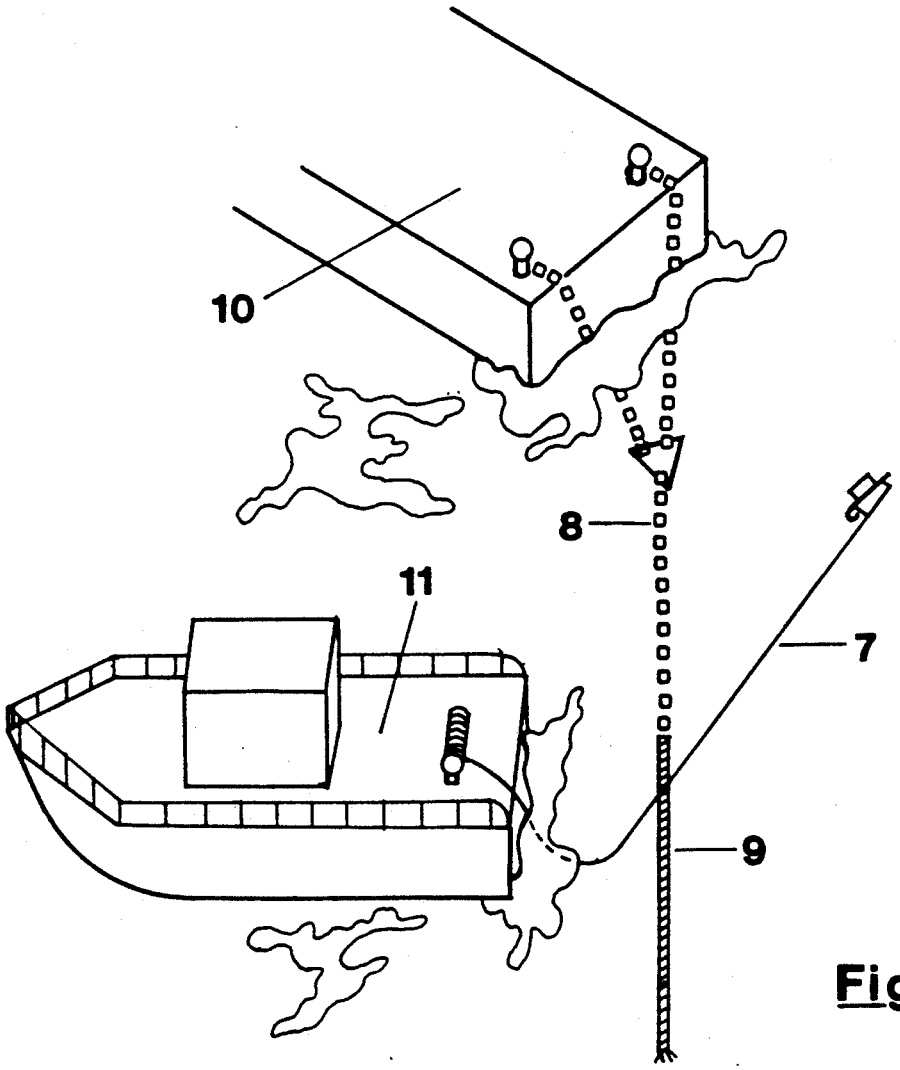
FIG. 2 is a perspective view illustrating the use of the hook assembly of FIG. 1 at sea.

In the towed configuration as shown in FIG. 2, the device will be laterally displaced proportional to the towing vessel's speed and be moving through the water. The operator of the towing vessel 11 passes at a safe distance from the barge 10 (such distance being less than the lateral displacement of the recovery towing cable and kook assembly) with the device at the desired depth (said depth being below the maximum draft of the barge) causing the towing cable 7 to come into contact with the chain bridle 8 or broken tow cable 9 hanging down in the water from the barge 10. Knowing the length of the chain bridle hanging from the barge allows the operator to tow the device at a depth that will retrieve either the chain bridle or the broken tow cable, whichever he desires.

Figure 3:
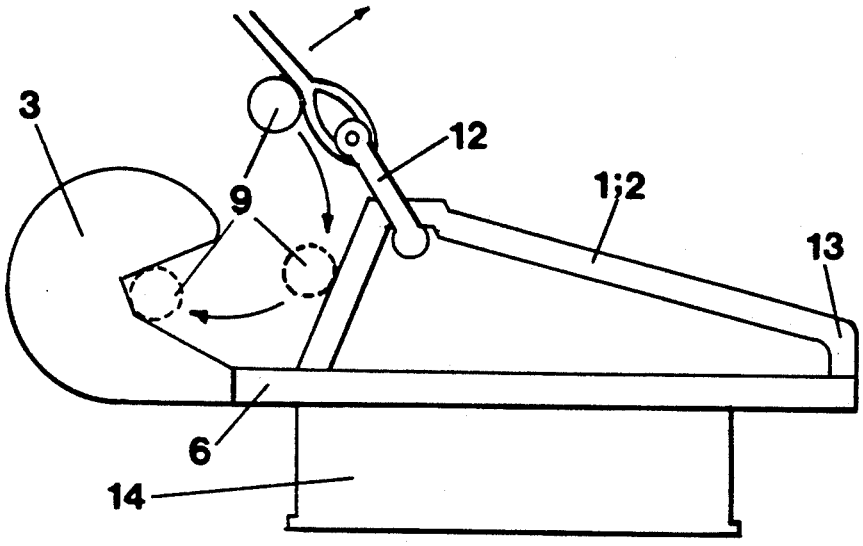
FIG. 3 is a view from above illustrating the hook assembly guiding and hooking a hanging cable.
Figure 4:
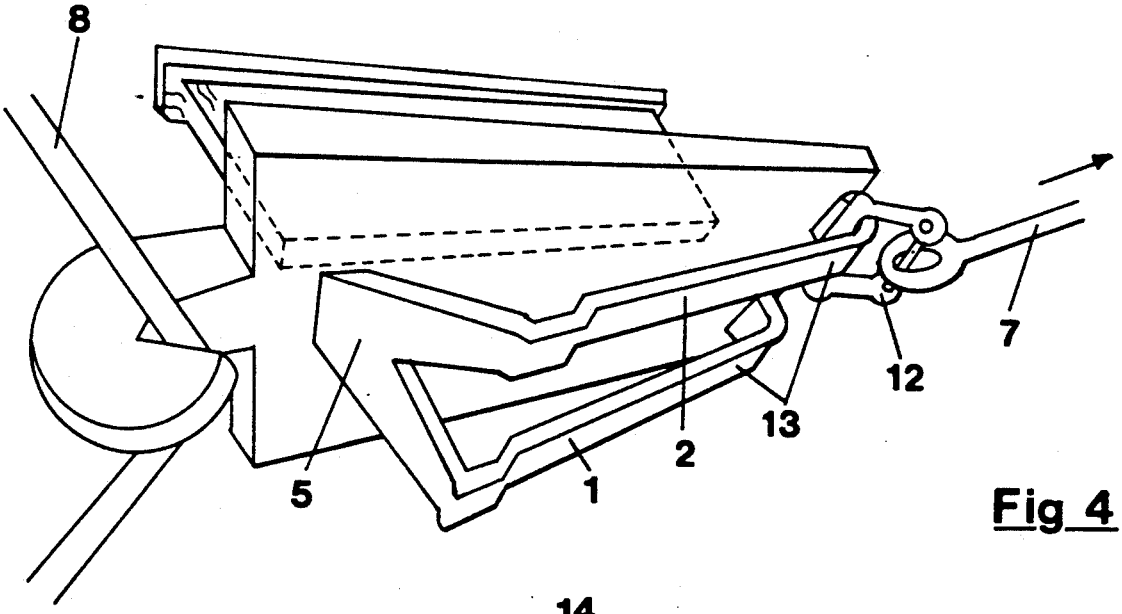
FIG. 4 is a perspective view showing the hook assembly after it has rotated to the retrieval/towing position.

FIG. 3 is a top view looking down along the axis of the hanging cable 9 which, after coming into contact with towing cable 7, will slide to and across the shackle 12, the face of the strut component 5, the face of the plate 6, and into the hook 3. My design of the hook allows for any size chain, cable, or line to be captured. As the cable is hooked, the device will rotate transversely about the kook, causing the shackle 12 to slide along the strut to the opposite end of the device at position 13. The device is now in the towing or retrieval configuration as shown in FIG. 4. The towing position 13, the kook 3, and the area in between will be constructed of high strength, noncorrosive material for a strong towing connection. The broken tow cable can be brought on board the tug and made fast or, if the operator initially set up the system at a depth to hook the chain bridle, the barge is now under emergency tow.

The same method is used to take a vessel in distress in emergency tow. The vessel in distress merely lets out the desired amount of anchor chain and the assisting vessel, using our invention, passes alongside, hooks the anchor chain and proceeds with the distressed vessel in tow.

Figure 5:
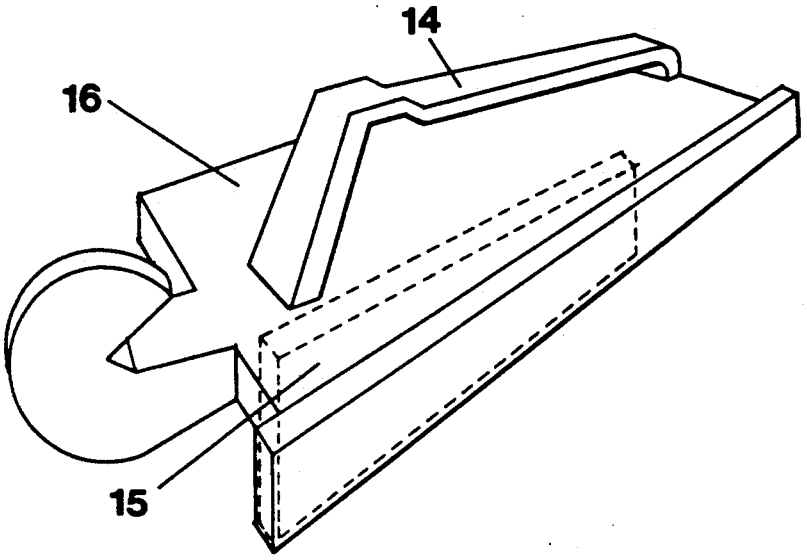
FIG. 5 is a perspective view of a unidirectional embodiment of the hook assembly.

Another possible embodiment is shown in FIG. 5, wherein the single strut 14 provides for unidirectional displacement with the weighted side of plate 16 and the keel 15 providing stability.

The word 'vessel' used herein described any surface craft or marine structure (e.g. boats, ships, buoys, and underway semi-submersible and jack-up drilling rigs). The words 'hanging towline' used herein described any chain, wire cable, line or rope attached to said vessel and extending below the surface of the water.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be defined not by this description, but rather by the claims appended hereto.

I claim:

1. A towable integrated hook assembly for retrieving a hanging towline from a marine vessel by retrieval from a towing vessel, said integrated hook assembly comprising:

(a) a hook member dimensioned to receive and intermediately capture and retain for retrieval or emergency towing a substantially vertically hanging towline below the surface without sliding on or cutting the towline, (b) a side planning member connecting with the hook member to carry the hook member substantially outside the line of motion of the towing vessel laterally towards the hanging towline when said hook assembly is towed, and (c) a strut member providing towing positions for both the deployment of the hook assembly and the retrieval of the captured hanging towline, said strut member extending angularly from said side planing member.

2. The towable hook assembly of claim 1, wherein the hook assembly provides a capture angle between an attached towing cable and the hook assembly, dimensioned to guide the hanging towline into the hook member.

3. The towable hook assembly of claim 1, wherein the hook assembly is adapted to rotate to a position for retrieval or emergency towing when the hanging towline is hooked by the hook member.

4. The towable hook assembly of claim 1, wherein weighting means are provided to maintain the towable hook assembly generally vertical.

5. The towable hook assembly of claim 1, wherein stabilizing means are provided to maintain the towable hook assembly generally vertical.

6. The towable hook assembly of claim 1, wherein two strut members with towing pennant attachment locations are provided for the hook assembly to be selectively displaceable to either side of the line of motion of the recovery towing vessel.

* * * * *